US011473246B2

(12) United States Patent
Yasui

(10) Patent No.: US 11,473,246 B2
(45) **Date of Patent: *Oct. 18, 2022**

(54) TISSUE PAPER PRODUCT AND TISSUE PAPER PRODUCT PACKAGE

(71) Applicant: DAIO PAPER CORPORATION, Shikokuchuo (JP)

(72) Inventor: Shuta Yasui, Fujinomiya (JP)

(73) Assignee: DAIO PAPER CORPORATION, Shikokuchuo (JP)

( * ) Notice: Subject to any disclaimer, the term of this patent is extended or adjusted under 35 U.S.C. 154(b) by 391 days.

This patent is subject to a terminal disclaimer.

(21) Appl. No.: 16/646,433

(22) PCT Filed: Aug. 31, 2018

(86) PCT No.: PCT/JP2018/032369

§ 371 (c)(1),
(2) Date: Mar. 11, 2020

(87) PCT Pub. No.: WO2019/058930

PCT Pub. Date: Mar. 28, 2019

(65) Prior Publication Data

US 2020/0277736 A1 Sep. 3, 2020

(30) Foreign Application Priority Data

Sep. 21, 2017 (JP) ..... JP2017-181733

(51) Int. Cl.

| | |
|---|---|
| ***D21H 27/00*** | (2006.01) |
| ***D21H 21/14*** | (2006.01) |
| ***D21H 27/30*** | (2006.01) |
| ***D21H 17/06*** | (2006.01) |
| ***A47K 10/20*** | (2006.01) |
| *A47K 10/42* | (2006.01) |

(52) U.S. Cl.

CPC ..... *D21H 27/005* (2013.01); *A47K 10/20* (2013.01); *D21H 17/06* (2013.01); *D21H 21/14* (2013.01); *D21H 27/30* (2013.01); *A47K 10/421* (2013.01)

(58) Field of Classification Search

None

See application file for complete search history.

(56) References Cited

FOREIGN PATENT DOCUMENTS

| | | | |
|---|---|---|---|
| CN | 102296488 | A | 12/2011 |
| CN | 104433930 | A | 3/2015 |

(Continued)

OTHER PUBLICATIONS

Definition of cuboid, Math.net, No Date, [Online], retrieved from the Internet, [retrieved Apr. 21, 2022], <URL: https://www.math.net/cuboid>. (Year: 2022).*

(Continued)

*Primary Examiner* — Dennis R Cordray
(74) *Attorney, Agent, or Firm* — Maier & Maier, PLLC

(57) ABSTRACT

A moisturizing tissue product that can be packaged in the same way as a non-moisturizing tissue product. With this tissue paper product, in which a web obtained by folding and laminating in a pop-up configuration a plurality of sheets of tissue paper containing a moisturizing agent is stored in a rectangular-shaped paper box having an outlet on an upper surface thereof, the problem of the tissue paper is solved by this tissue paper product in which the number of plies is 2.

4 Claims, 8 Drawing Sheets

(56) References Cited

FOREIGN PATENT DOCUMENTS

| | | | |
|---|---|---|---|
| CN | 106605025 | A | 4/2017 |
| CN | 106715798 | A | 5/2017 |
| CN | 107095611 | A | 8/2017 |
| CN | 107105947 | A | 8/2017 |
| EP | 3165142 | A1 | 5/2017 |
| JP | 2004-65290 | A | 3/2004 |
| JP | 2010-233973 | A | 10/2010 |
| JP | 4715076 | B2 | 7/2011 |
| JP | 5622478 | B2 | 2/2012 |
| JP | 2012110407 | A | 6/2012 |
| JP | 2014-138897 | A | 7/2014 |
| JP | 5732502 | B2 | 3/2015 |
| JP | 2016-131599 | A | 7/2016 |
| JP | 2017070606 | A | 4/2017 |
| WO | 2009123175 | A1 | 10/2009 |
| WO | 2017/056712 | A1 | 4/2017 |

OTHER PUBLICATIONS

Definition of rectangular parallelopiped, www.mathwords.com, No Date, [Online], retrieved from the Internet, [retrieved Apr. 22, 2022], <URL: https://www.mathwords.com/r/rectangular_parallelepiped.htm>. (Year: 2022).*

Office Action dated Oct. 23, 2019 in corresponding Japanese Application No. 2017-181733; 3 pages including English-language translation.

Translation of International Search Report dated Nov. 20, 2018 and Written Opinion of corresponding application No. PCT/JP2018/032369; 6 pgs.

Chinese Office Action dated Mar. 31, 2021 in corresponding application No. 201880057666.7; 12 pgs.

Extended European Search Report dated Oct. 16, 2020 in corresponding application No. 18859511.0; 6 pgs.

* cited by examiner

[FIG. 1]
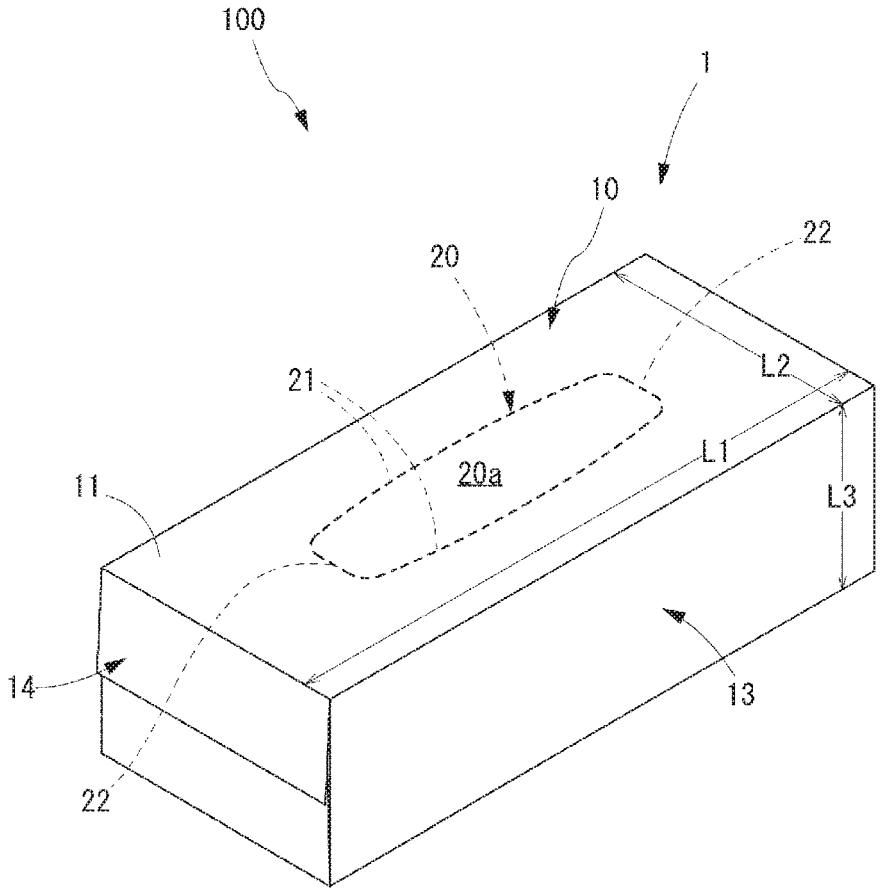

[FIG. 2]
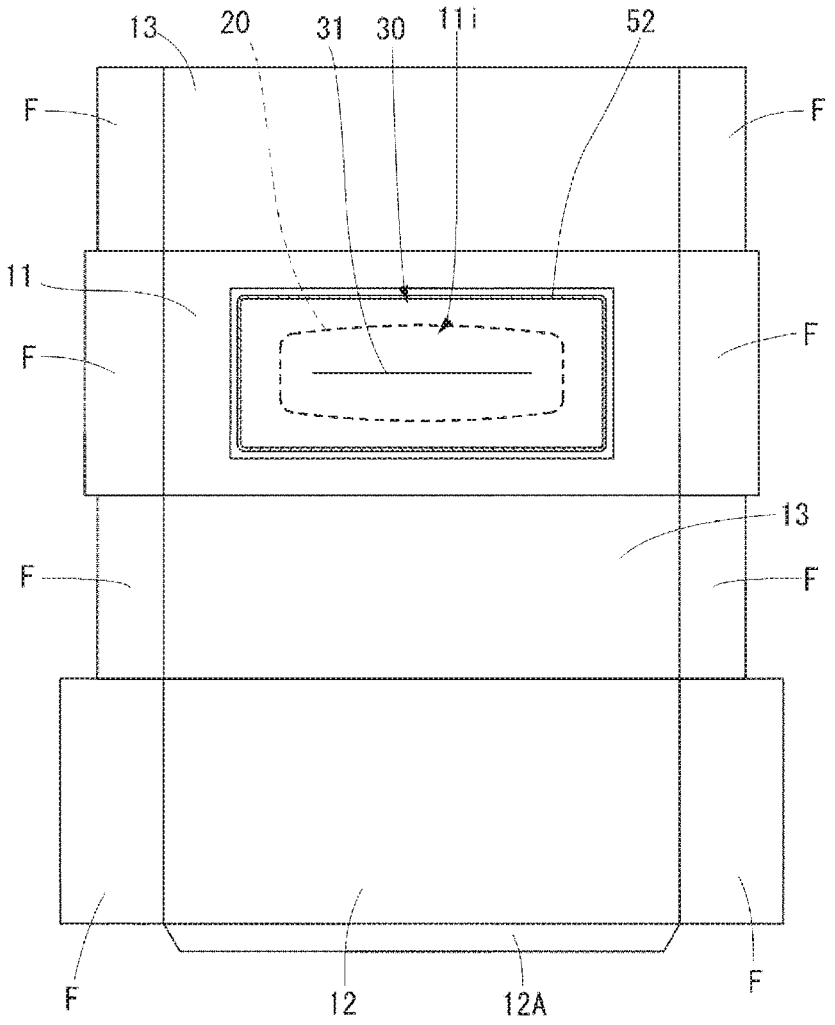

[FIG. 3]
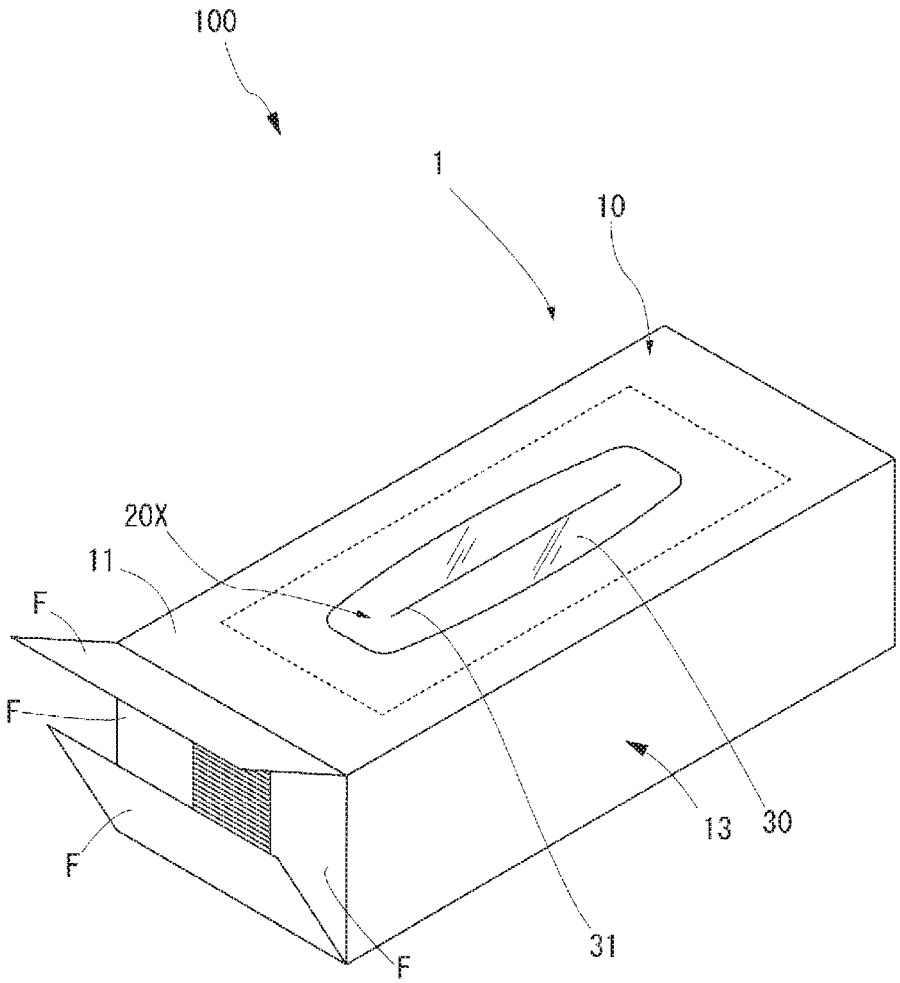

[FIG. 4]
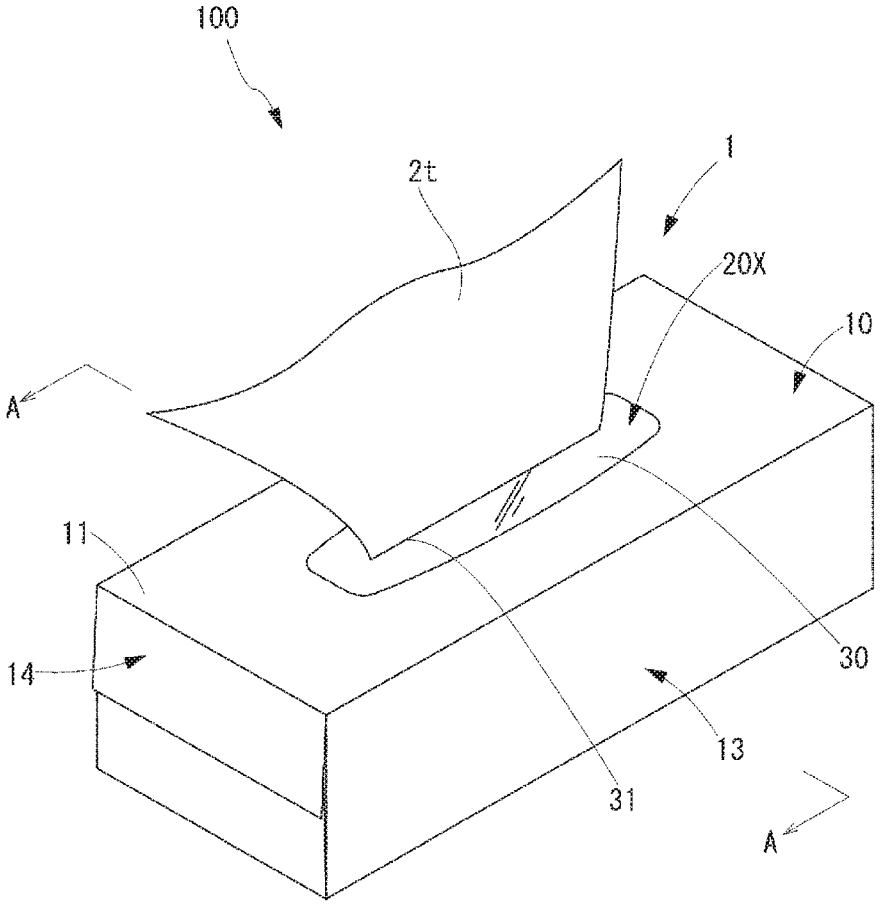

[FIG. 5]
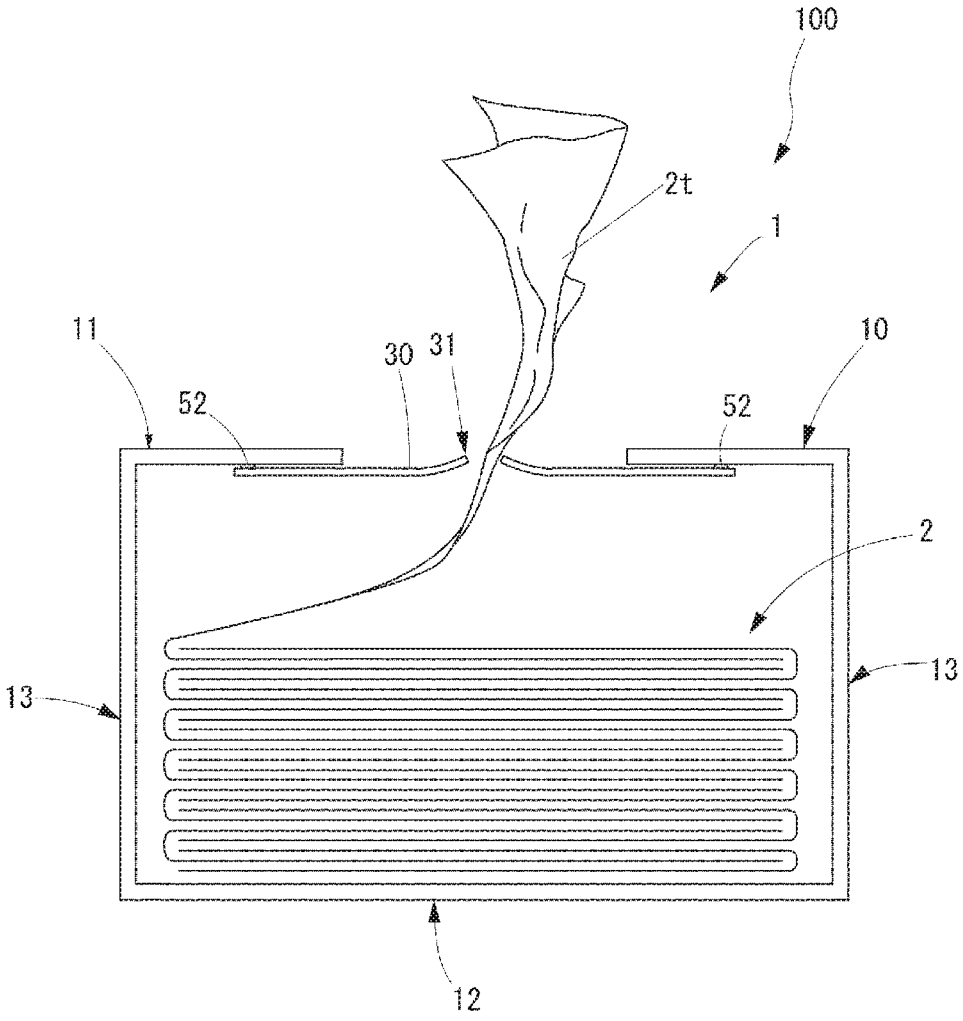

[FIG. 6]
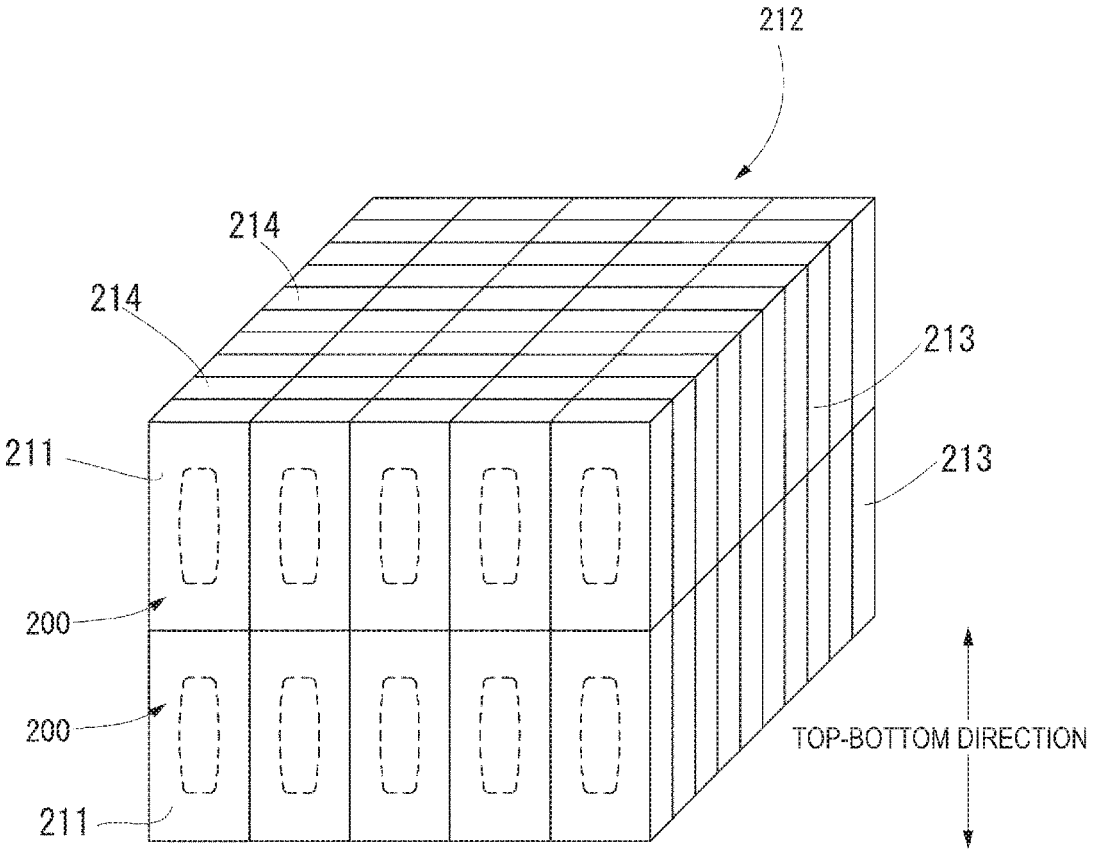

[FIG. 7]
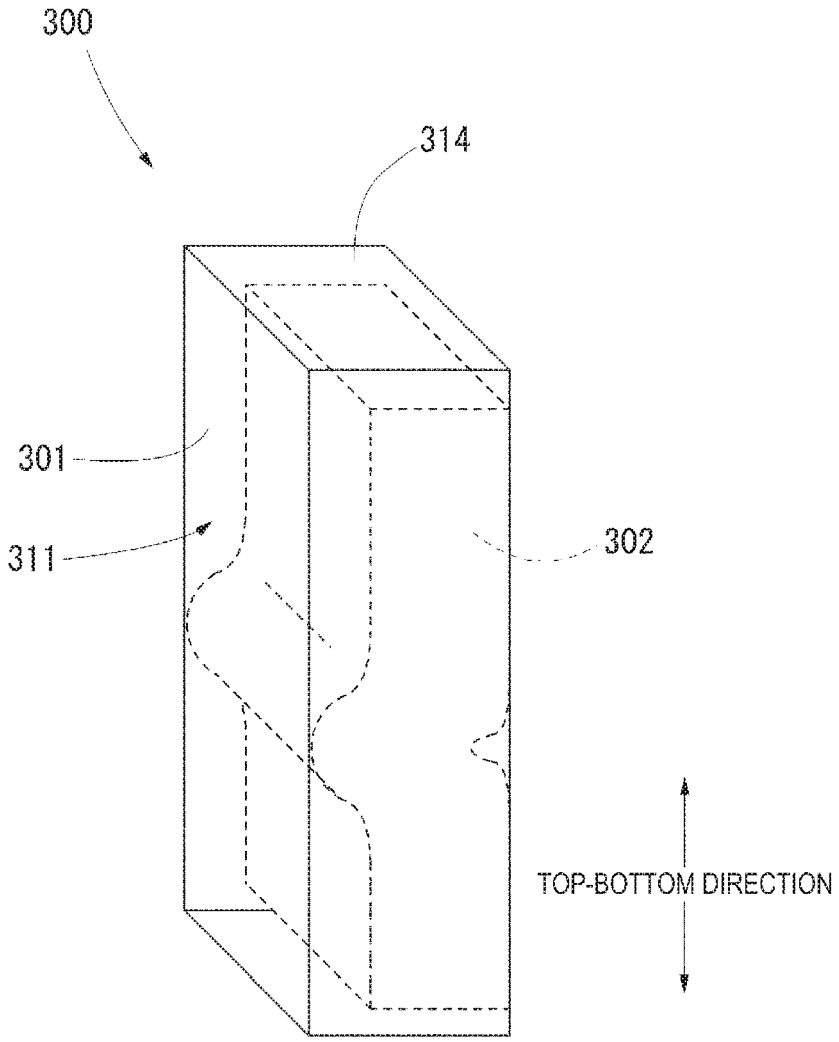

[FIG. 8]
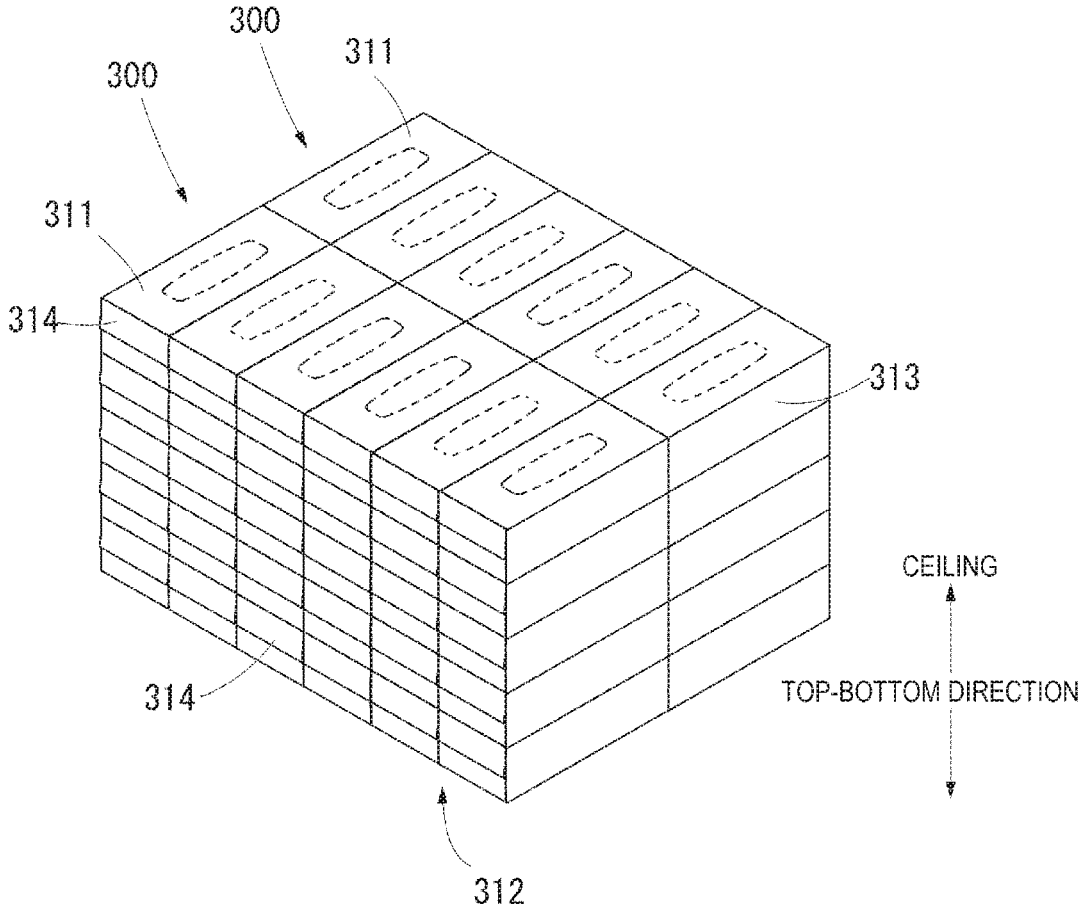

TISSUE PAPER PRODUCT AND TISSUE PAPER PRODUCT PACKAGE

FIELD

The present invention relates to a tissue paper product, and more particularly to a tissue paper product comprising tissue paper to which a moisturizer has been applied, and a storage box storing the tissue paper, and to a tissue paper product package comprising a plurality of such tissue paper products, and a cardboard case storing the tissue paper products.

BACKGROUND

A tissue paper product is well known which comprises a web, obtained by folding and stacking a plurality of sets of tissue paper, and a paper box storing the web. Such a tissue paper product generally has a rectangular parallelepiped shape with rectangular upper and lower surfaces, short side surfaces and long side surfaces, and has an outlet in the upper surface.

In general, a plurality of, for example 3 or 5, tissue paper products are vertically stacked and packaged in a film. A plurality of such packs are arranged and stored in a cardboard case, also called a cardboard box or the like, for transportation, shipment, storage or the like.

Tissue paper products include products in which tissue paper, to which a moisturizer has been applied, is stored in a box, and products called general-purpose products in which common tissue paper, to which no moisturizer has been applied, is stored in a box.

Tissue paper in a general-purpose product has a low moisture content because no moisturizer has been applied to the paper. Therefore, the web of the tissue paper has a high elasticity. On the other hand, the web of moisture-retaining tissue paper is moist and soft due to the hygroscopic effect of a moisturizer, and is not as elastic as the web of a general-purpose product. Therefore, as shown in FIG. 7, a web 302 is likely to bend in a box during display of the product on a shelf or by a shock during transportation. The web 302 hardly recovers from the bent state. When the web 302 is bent in a storage box 301, the tissue paper cannot be smoothly popped up and taken from an outlet provided in an upper surface 311.

In view of this, the above-described tissue paper products are stored in a cardboard case as follows. As shown in FIG. 6, general-purpose products 200 are packed in a cardboard case in such a manner that short side surfaces 214 of each product 200 face in the top-bottom direction of the cardboard case (vertical direction). On the other hand, as shown in FIG. 8, moisture-retaining tissue products 300 are packed in a cardboard case in such a manner that the upper surface 311 of each product 300 faces toward the ceiling (upward) in the top-bottom direction of the cardboard case so that the web 302 will not bend.

The manner of packaging moisture-retaining tissue products requires the use of a cardboard case having an increased strength. In particular, when tissue products are packed in a cardboard case in such a manner that the short side surfaces 214 of each product face in the top-bottom direction of the cardboard case as in the case of the general-purpose products shown in FIG. 6, long side surfaces 213, an upper surface 211 and a lower surface 212 function as a post in the cardboard case. On the other hand, when tissue products are packed in a cardboard case in such a manner that the upper surface 311 of each product faces toward the ceiling as in the case of the moisture-retaining tissue products shown in FIG. 8, the short side surfaces 314 and the long side surfaces 313 function as a post. The upper surface 311 and the lower surface 312 of a storage box have a larger area than the short side surface 314. Accordingly, the number of surfaces that function as posts is smaller in the packaged moisture-retaining tissue products than in the packaged general-purpose tissue products. This requires the use of a cardboard case having an increased strength for packaging of the moisture-retaining tissue products.

The direction of packs of moisture-retaining tissue products when packing them into a cardboard case thus differs from that of packs of general-purpose tissue products which are produced in large quantities. This requires a troublesome operation to change the direction of packs of moisture-retaining tissue products when packing them into a cardboard case.

It is possible to simply reduce the amount of a chemical used in a moisture-retaining tissue and to thereby make the tissue approximate a general-purpose tissue so as to enhance the cushioning properties of the web. However, to merely use such a method reduces the smoothness and softness of the moisture-retaining tissue.

CITATION LIST

Patent Literature

Patent document 1: Japanese Patent No. 4715076

SUMMARY

It is therefore a primary object of the present invention to provide a tissue paper product which, despite a product of moisture-retaining tissue paper having excellent "softness" and "smoothness", is excellent in the cushioning properties of the web and can be packaged in the same manner as used for general-purpose products, and to provide a tissue paper product package in which a number of such tissue paper products are packaged.

Solution to Problem

The following are means for solving the above problems.

The first means is a tissue paper product comprising: a web obtained by folding and stacking in a pop-up manner a plurality of sheets of tissue paper containing a moisturizer; and a rectangular parallelepiped paper box storing the web and having an outlet in its upper surface, wherein the sheets of tissue paper are 2-ply sheets having a 1-ply basis weight of not less than 11.7 g/m$^2$ and not more than 13.0 g/m$^2$ and having a 2-ply paper thickness of more than 123 μm and not more than 145 μm, the dry tensile strength of the tissue paper is more than 273 cN/25 mm and not more than 352 cN/25 mm in the machine direction, and more than 98 cN/25 mm and less than 132 cN/25 mm in the cross-machine direction, and the content of the moisturizer in the tissue paper is not less than 1.0 g/m$^2$ and less than 2.5 g/m$^2$, wherein the web has a web compressive stress of more than 0.47 g/cm$^2$ and less than 0.89 g/cm$^2$, wherein the ratio of the product of the paper thickness and the number of the 2-ply sheets to a web bulk is not less than 0.34, wherein the ratio of the web bulk to the height of the paper box is not less than 0.95 and less than 1.03, wherein the ratio of the length of the tissue paper in the cross-machine direction to the length of the paper box in the longitudinal direction is not less than 0.84, and wherein the space volume ratio of the tissue paper product is not less than 79%.

The second means is the tissue paper product as the first means, wherein the moisturizer comprises glycerin and 1,3-propanediol, with the mass ratio between glycerin and 1,3-propanediol being not less than 1:0.06 and not more than 1:0.08, and the content of the moisturizer in the tissue paper is not less than 1.0 g/m$^2$ and less than 2.5 g/m$^2$.

The third means is a tissue paper product package comprising a plurality of tissue paper products, and a cardboard case storing the tissue paper products, the tissue paper products being packed and stored in the cardboard case in such a manner that the short side surfaces of each tissue paper product face in the top-bottom direction of the cardboard case, and the tissue paper products each comprising: a web obtained by folding and stacking in a pop-up manner a plurality of sheets of tissue paper containing a moisturizer; and a rectangular parallelepiped paper box storing the web and having an outlet in its upper surface, wherein the sheets of tissue paper are 2-ply sheets having a 1-ply basis weight of not less than 11.7 g/m$^2$ and not more than 13.0 g/m$^2$ and having a 2-ply paper thickness of more than 123 μm and not more than 145 μm, the dry tensile strength of the tissue paper is more than 273 cN/25 mm and not more than 352 cN/25 mm in the machine direction, and more than 98 cN/25 mm and less than 132 cN/25 mm in the cross-machine direction, and the content of the moisturizer in the tissue paper is not less than 1.0 g/m$^2$ and less than 2.5 g/m$^2$, wherein the web has a web compressive stress of more than 0.47 g/cm$^2$ and less than 0.89 g/cm$^2$, wherein the ratio of the product of the paper thickness and the number of the 2-ply sheets to a web bulk is not less than 0.34, wherein the ratio of the web bulk to the height of the paper box is not less than 0.95 and less than 1.03, wherein the ratio of the length of the tissue paper in the cross-machine direction to the length of the paper box in the longitudinal direction is not less than 0.84, and wherein the space volume ratio of the tissue paper product is not less than 79%.

The fourth means is the tissue paper product package as the third means, wherein the moisturizer comprises glycerin and 1,3-propanediol, with the mass ratio between glycerin and 1,3-propanediol being not less than 1:0.06 and not more than 1:0.08, and the content of the moisturizer in the tissue paper is not less than 1.0 g/m$^2$ and less than 2.5 g/m$^2$.

Advantageous Effects of the Invention

According to the present invention, a tissue paper product is provided which, despite a product of moisture-retaining tissue paper having excellent "softness" and "smoothness", is excellent in the cushioning properties of the web and can be packaged in the same manner as used for general-purpose products. There is also provided a tissue paper product package in which a number of such tissue paper products are packaged.

BRIEF DESCRIPTION OF THE DRAWINGS

FIG. 1 is a diagram showing a tissue paper product according to the present invention;

FIG. 2 is a diagram showing a box in the developed state;

FIG. 3 is another diagram showing the tissue paper product according to the present invention;

FIG. 4 is a diagram showing the tissue paper product according to the present invention when it is in use;

FIG. 5 is a schematic diagram of the cross-section V-V of FIG. 4;

FIG. 6 is a diagram illustrating the manner of packaging general-purpose tissue paper products;

FIG. 7 is a diagram illustrating bending of a web in a box; and

FIG. 8 is a diagram illustrating the manner of packaging conventional products of conventional moisture-retaining tissue paper.

DETAILED DESCRIPTION

Embodiments of the present invention will now be described with reference to FIGS. 1 through 5.

A tissue paper product 100 comprises a web 2 of tissue paper obtained by folding and stacking a plurality of sets of tissue paper sheets 2*t*, 2*t* . . . containing a moisturizer, the sets each consisting of a 2-ply sheet, and a storage box 1 storing the web 2. The storage box 1 has, in its upper surface 11, a perforation line 20 for tearing for the formation of an outlet. When the tissue paper 2-ply sheet 2*t* is taken from an outlet 20X during use of the product 100, part of an adjacent underlying tissue paper sheet becomes exposed from the outlet 20X.

In the web 2 of tissue paper, each rectangular tissue paper sheet 2*t* is substantially folded into two pieces. The tissue paper sheets are stacked while overlapping alternately each other such that the opposite ends of the two pieces of each folded sheet are respectively located inside upper and lower adjacent folded sheets. Such a web is sometimes called a pop-up web. As used herein, the term "substantially" allows for some turnback that can occur in the edge of a sheet during a manufacturing process.

In the web 2 of tissue paper having the above-described stack structure, when one piece of a topmost 2-ply folded sheet is pulled up, then one piece of an adjacent 2-ply sheet, located just under the topmost sheet, is dragged upward and raised by friction. The topmost surface of the web 2, having such a structure and stored in the storage box 1, faces the upper surface 11 of the storage box 1 having the outlet 20X in the upper surface 11. When the first set of 2-ply sheet (located at the top of the web) is pulled from the outlet 20X, in particular from a slit 31, then part of another set, located just under the first set, becomes exposed. In the present invention, there is no particular limitation on the number of 2-ply tissue paper sheets (sets) 2*t* stacked in the web 2. However, 120 to 240 sets may be generally stacked in this type of tissue product. The web 2 can be produced by means of a multi-stand or rotary interfolder.

The tissue paper sheets 2*t*, constituting the web 2, are 2-ply tissue paper sheets. Thus, a laminate of two thin paper sheets constitutes one set. A mixture of a needle bleached kraft pulp, abbreviated as NBKP, and a leaf breached kraft pulp, abbreviated as LBKP, may be used as a raw material pulp for the thin paper sheets. The raw material pulp may contain an appropriate amount of a used-paper pulp; however, the raw material pulp is preferably composed only of NBKP and LBKP e.g. from the viewpoint of texture. The mixing ratio NBKP:LBKP may preferably be 20:80 to 80:20, more preferably 30:70 to 60:40.

The tissue paper 2*t* can be produced by a known papermaking technique. It is preferred to add cotton linter to the raw material pulp in an amount of not more than 1 kg per ton of pulp. The cotton linter will be entwined with pulp fibers, which may impart a fluffy soft texture to the tissue paper. The basis weight of one ply of the tissue paper 2*t* containing a moisturizer is not less than 11.7 g/m$^2$ and not more than 13.0 g/m$^2$. The use of this range of basis weight can ensure sufficient softness and strength of the tissue paper. Further, the web can have good cushioning properties. This, together with the below-described relationship with a paper box, makes it possible to package the moisture-retaining tissue products in the same manner as used for general-purpose products. The basis weight is measured by a basis weight measuring method according to JIS P 8124 (1998).

The thickness of two plies of the tissue paper is more than 123 μm and not more than 145 μm. The use of this range of paper thickness can ensure sufficient softness and strength of the tissue paper. Further, such a paper thickness can ensure good cushioning properties of the web. This, together with the below-described relationship with a paper box, makes it possible to package the moisture-retaining tissue products in the same manner as used for general-purpose products. The paper thickness is measured in the following manner: after performing adequate moisture conditioning of a 2-ply test specimen under the conditions of JIS P 8111 (1998), the thickness of the test specimen is measured under the same conditions using Dial Thickness Gauge (thickness measuring device) "PEACOCK Type G" (manufactured by Ozaki Mfg. Co., Ltd.). In particular, the paper thickness is measured by a method comprising: lowering a plunger onto a measuring stage after checking the absence of dust, etc. between the plunger and the measuring stage; performing zero point adjustment by moving a scale of the Dial Thickness Gauge; raising the plunger and placing the test specimen on the measuring stage; and slowly lowering the plunger onto the test specimen, and reading the gage. The plunger is simply put on the test specimen. The plunger has a metal terminal having a circular plane with a diameter of 10 mm. The circular plane of the terminal makes contact with the plane of the test specimen at a right angle. The load at the time of the paper thickness measurement is about 70 gf. A paper thickness value herein is the average of 10 measurement values.

The dry tensile strength of the tissue paper in the machine direction is more than 273 cN/25 mm and not more than 352 cN/25 mm. The dry tensile strength of the tissue paper in the cross-machine direction is more than 98 cN/25 mm and less than 132 cN/25 mm. The above ranges of the dry tensile strength in the machine direction and in the cross-machine direction can ensure sufficient softness and strength of the tissue paper. Further, the web can have good cushioning properties. This, together with the below-described relationship with a paper box, makes it possible to package the moisture-retaining tissue products in the same manner as used for general-purpose products. The machine direction of paper, also called MD direction, herein refers to the flow direction in a paper-making process for the paper. The cross-machine direction of paper, also called CD direction, herein refers to a direction perpendicular to the flow direction (MD direction) in a paper-making process for the paper. The dry tensile strength is measured according to JIS P 8113 as follows. A test specimen for machine direction and a test specimen for cross-machine direction, each having a width of about 25 mm (±0.5 mm) and a length of about 150 mm, are prepared by cutting a tissue paper sheet. The tissue paper specimens, each consisting of a multi-ply sheet, are used as they are in the measurement. A load cell tensile testing machine TG-200N, manufactured by Minebea Co., Ltd., or a machine equivalent thereto, can be used as a testing machine. The chuck-to-chuck distance is set to 100 mm, and the tensile speed is set to 100 mm/min. The measurement is performed by the steps of: fastening both ends of a test specimen to the chucks of the testing machine; applying a vertical tensile load to the test specimen; and reading an indication value (digital value) upon breaking of the test specimen. 5 specimens are prepared for each of the machine direction and the cross-machine direction. Thus, the measurement is performed 5 times for each direction, and the average of 5 measurement values for each direction is taken as a dry tensile strength value in the direction. The dry tensile strength can be increased by adding a dry paper strength agent to paper feedstock or wet paper. Examples of the dry paper strength agent include starch, polyacrylamide, and CMC (carboxymethyl cellulose) or its salts such as sodium carboxymethyl cellulose, calcium carboxymethyl cellulose and zinc carboxymethyl cellulose.

The content of the moisturizer in the tissue paper is not less than 1.0 g/m$^2$ and less than 2.5 g/m$^2$. The use of the moisturizer in such an amount can fully exert its effect of enhancing the softness of the tissue paper. The moisturizer content is on absolute dry basis. The "absolute dry" herein refers to a state of the tissue paper in which its weight has become constant after drying it at a temperature of 65° C. and a humidity of 10%. The moisturizer is one called a water-based chemical or a lotion chemical, and preferably comprises at least one of a polyol, a saccharide and 1,3-propanediol. Examples of the polyol include polyvalent alcohols such as glycerin, diglycerin, propylene glycol, 1,3-butylene glycol, polyethylene glycol, and their derivatives. Examples of the saccharide include sorbitol, glucose, xylitol, maltose, maltitol, mannitol, and trehalose. An especially preferred moisturizer comprises glycerin and 1,3-propanediol. The hygroscopic effect of glycerin increases the moisture content of the tissue paper, thereby enhancing the moist texture and softness of the tissue paper. On the other hand, 1,3-propanediol enhances "softness" and, in addition, provides the paper surface with a smooth texture. Thus, the combination of the two components can provide tissue paper having excellent "softness", "fluffy and bulky texture" and "surface smoothness". Further, the web can have good cushioning properties and can be appropriately restrained in a storage box. This, together with the below-described relationship with a paper box, makes it possible to package the moisture-retaining tissue products in the same manner as used for general-purpose products. When the moisturizer comprises glycerin and 1,3-propanediol, the mass ratio between glycerin and 1,3-propanediol is preferably not less than 1:0.06 and not more than 1:0.08, and the content of the moisturizer in the tissue paper is preferably not less than 1.0 g/m$^2$ and less than 2.5 g/m$^2$. Further, it is preferred that the tissue paper contain glycerin in an amount of not less than 79.4 mass % and not more than 80.4 mass %, and contain 1,3-propanediol in an amount of not less than 5.0 mass % and not more than 6.5 mass %. When the moisturizer comprises glycerin and 1,3-propanediol, the tissue paper may also contain a known auxiliary agent in addition to glycerin and 1,3-propanediol. Examples of the auxiliary agent include a hydrophilic polymeric gelling agent for enhancing the moisture-retaining properties of the tissue paper, a surfactant, a softness improver, a slight amount of an oily component, such as liquid paraffin, for assisting in the development of smoothness, and an emulsifier, a preservative, a defoamer, etc. for improving the stability and the coating properties of the moisturizer. Components such as a saccharide, an auxiliary moisturizing agent, and a hydrophilic polymeric gelling agent for enhancing the moisture-retaining properties of the tissue paper, may be used in such an amount as not to excessively affect the "fluffy and bulky texture", "softness" and "surface smoothness" of the tissue paper. More specifically, such a component may be used in an amount of not more than 1.0 mass %, preferably not more than 0.6 mass %, more preferably not more than 0.5 mass %.

On the other hand, the web according to the present invention has a web compressive stress of more than 0.47 g/cm$^2$ and less than 0.89 g/cm$^2$. The web compressive stress is measured by the following steps (1) to (5).

(1) A web is taken out of a paper box, and left to stand for 24 hours in a constant-temperature, constant-humidity room (humidity conditioning environment: 23° C., 50% R.H specified in JIS P 8111).

(2) The web is placed on a horizontal level testing stage, and the web bulk is measured in the following manner: an acrylic plate having a width of 120 mm, a length of 220 mm and a thickness of 3 mm is placed and allowed to stand on the web, and the heights of the four corners of the acrylic plate above the testing stage are measured with a metal ruler (JIS first class), and the average is calculated. The same measurement is performed on 5 samples, and the average of the five calculated average values is takes as a web bulk value. In cases where the edge of the web projects from the acrylic plate having the above size, a rectangular acrylic plate, having such a size that its edge projects from the web within the range of not more than 5 mm from the edge of the upper surface of the web, is used. An acrylic plate to be used should have such a mass as not to cause sinking of the upper surface of the web when the plate is placed on it. For a rectangular parallelepiped web of a known shape, consisting of at least 100 sets of tissue paper, an acrylic plate having a mass of not more than 80 g will suffice.

(3) A 200-g weight (M1CSB-200GJ, manufactured by taisho Balance Mfg. Co., Ltd.) is placed on the center of the acrylic plate to compress the web and, in the same manner as in the above step (2), the heights of the four corners of the acrylic plate above the testing stage are measured with the metal ruler (JIS first class), and the average is calculated. The same measurement is performed on 5 samples, and the average of the five calculated average values is taken as a compressed web bulk value.

(4) The weight of a weight, which is necessary to compress the web bulk by 1 mm, is calculated from the weight (200 g) of the weight placed on the acrylic plate and from the difference between the web bulk value and the compressed web bulk value.

(5) The weight (g) of a weight, which is necessary to compress the web bulk by 1 mm per cm$^2$ of the web, is calculated from the area of the web in contact with the acrylic plate, and the calculated value is taken as a web compressive stress value.

The web compressive stress can be adjusted by the paper thickness, the basis weight, the number of sheets (sets) constituting the web, and the tension applied upon the formation of the web. The use of the web compressive stress in the above-described range can provide a web which has sufficiently high cushioning properties, and therefore is less likely to bend in a storage box. This makes it possible to package the moisture-retaining tissue products in the same manner as used for general-purpose products.

On the other hand, the storage box for storing the web of tissue paper is a storage box having a rectangular parallelepiped shape, also called a carton box, and constitutes the shell of the product. The storage box 1 includes a paper box which has, in the upper surface 11, the perforation line 20 for tearing for the formation of the outlet 20X, and a sheet material 30 which covers the interior side of an area 20*a* surrounded by the perforation line 20.

A paper box 10 constitutes the shell of the storage box 1, and has a size, a shape, a developed shape, etc. which can be the same as those of any known storage box. The size of a common storage box is as follows: the length L1 of a long edge is about 110 to 320 mm; the length L2 of a short edge is about 70 to 200 mm; and the height L3 is about 40 to 150 mm. The storage box 1 according to the present invention can have the same size.

Known paper materials, produced from various pulps such as a virgin pulp and a used-paper pulp as a main material, can be used as a base material for the paper box 10. Coated cardboard having a basis weight of 250 to 500 g/m$^2$ is a preferred paper material for the paper box 10.

As shown in FIGS. 2 and 3, the paper box 10 has a structure obtained by a process comprising: attaching a bottom surface 12 to one long side surface 13 with an adhesive in an adhesive tab portion 12A to form a rectangular tubular shape; folding flaps F, F . . . , extending from the upper surface 11, the bottom surface 12, and the long side surfaces 13 connecting the upper and lower surfaces, inward toward the interior of the box; and bonding contact portions of the flaps F, F . . . with a hot-melt adhesive or the like to form short side surfaces 14. However, the structure of the paper box 10 of the present invention is not limited to the above-described one.

On the other hand, the perforation line 20 for tearing, formed in the upper surface of the paper box 10 of the storage box 1, is annular-shaped or approximately C-shaped, and is formed with an appropriate cut/tie ratio. In the illustrated embodiment, the perforation line 20 for tearing has an annular shape. Besides a common perforation line, the perforation line 20 for tearing may be a double perforation line, a zipper perforation line, or the like. The perforation line 20 may be a double perforation line only in part. The perforation line 20 for tearing has long sides 21, 21 extending in the longitudinal direction of the paper box, and short sides 22, 22 each connecting the opposing ends of the long sides 21, 21 and extending parallel to the short edges of the paper box. The area 20*a* surrounded by the perforation line 20 for tearing has an appropriate shape which is longer in the longitudinal direction of the storage box 1. In general, the area 20*a* has a somewhat elongated corner-rounded rectangular shape which is longer in the longitudinal direction of the storage box 1, or an ellipse-like shape obtained by slightly expanding outward and arching the central portions of the long sides 21, 21 of the rectangular shape. In the illustrated embodiment, the area 20*a* has the latter shape.

On the other hand, the sheet material 30 of the storage box 1 is larger than the area 20*a* surrounded by the perforation line 20 for tearing and has, for example, a rectangular or an elliptical shape, and is attached with an adhesive 52 to the interior side of the upper surface of the paper box. The adhesive 52 is applied to an area lying outside the perforation line 20 for tearing so as not to affect tearing-off of the perforation line 20. The sheet material 30 has the slit 31 located inside the area 20*a* surrounded by the perforation line 20 for tearing and extending in the longitudinal direction. Therefore, as shown in FIGS. 3 and 4, by tearing off the area 20*a* surrounded by the perforation line 20 for tearing along the perforation line 20 for tearing, the outlet 20X is formed in the upper surface 11 and, at the same time, the sheet material 30 and the slit 31 formed in it become exposed through the outlet 20X.

As illustrated, the 2-ply sheets (sets) 2*t* of tissue paper or the like, stored as a web in the storage box 1, are taken one by one from the outlet 20X through the slit 31. The slit 31 supports a part of the tissue paper sheet 2*t*, which is exposed from the outlet 20X, and prevents it from sinking into the storage box.

In the tissue paper product of this embodiment, the ratio of the product of the paper thickness and the number of sets to the web bulk is not less than 0.35. The web bulk is measured by the method described above with reference to the measurement of the web compression ratio. Thus, a web is taken out of a paper box, and left to stand for 24 hours in a constant-temperature, constant-humidity room (humidity conditioning environment: 23° C., 50% R.H specified in JIS P 8111). Thereafter, the web is placed on a horizontal level testing stage, and an acrylic plate (thickness 3 mm, width 22 mm, length 120 mm) is placed and allowed to stand on the web. The heights of the four corners of the acrylic plate above the testing stage are measured with a metal ruler (JIS first class), and the average is calculated. The same measurement is performed on 5 samples, and the average of the five calculated average values is taken as a web bulk value. When the ratio of the product of the paper thickness and the number of sets to the web bulk is not less than 0.35, the web can have sufficiently high cushioning properties, and therefore is less likely to be crushed or bent in a storage box. This makes it possible to package the moisture-retaining tissue products in the same manner as used for general-purpose products.

Further, in the tissue paper product, the ratio of the web bulk to the height of the paper box is not less than 0.95 and less than 1.03. When the ratio is in this range, the web is in a vertically uncrushed or slightly crushed state in the paper box. Therefore, the web has excellent cushioning properties and restorability, and is less likely to bend in the storage box. This makes it possible to package the moisture-retaining tissue products in the same manner as used for general-purpose products. Further, since the web is not in an excessively crushed state, the tissue paper sheets (sets), when used, are not thinned nor hardened. Thus, the excellent "softness" and "smoothness" peculiar to moisture-retaining tissue paper are not impaired.

Further, in the tissue paper product 100, the ratio of the length of the tissue paper in the cross-machine direction to the length of the paper box 10 in the longitudinal direction (width direction) is not less than 0.84, and the space volume ratio is not less than 79%. When the ratio of the length of the tissue paper in the cross-machine direction to the length of the paper box 10 in the longitudinal direction is not less than 0.84, movement of the web in the paper box in the longitudinal direction is restricted, and therefore the web is less likely to bend. Further, when the space volume ratio is not less than 79%, the web is less likely to bend in the storage box. As used herein, the "space volume ratio" refers to the ratio of the product of the web bulk, the depth of the web and the length of the tissue paper in the cross-machine direction (MD direction) to the product of the height of the external surface of the paper box (the distance between the upper and lower surfaces), the width of the external surface of the paper box (the length of the upper surface in the longitudinal direction) and the depth of the external surface of the paper box (the short-side length of the upper surface). The height, the width and the length of the paper box 10 and the depth of the web are measured with a metal ruler (JIS first class), while the thickness of the paper is neglected.

While the web 2 of tissue paper can be produced by means of a multi-stand interfolder or a rotary interfolder, a preferred web is produced by a multi-stand interfolder. In the case of a web produced by a multi-stand interfolder, the longitudinal direction in which the folded edges of the web are arranged coincides with the machine direction (MD direction) of the paper. In the tissue paper, irregularities called crepe extend in the cross-machine direction (CD direction) perpendicular to the machine direction (MD direction). The web is less slidable and less likely to bend when the longitudinal direction of the web coincides with the machine direction (MD direction) in which the irregularities are present alternately at intervals.

As shown in FIG. 6, the above-described tissue paper product according to the present invention is preferably packed and stored in a cardboard case in such a manner that the short side surfaces of the tissue product face in the top-bottom direction of the cardboard case. It is, of course, possible to vertically stack and package in a film a plurality of, for example 3 or 5, tissue paper products, and to pack and store such packs in a cardboard case as is commonly practiced. If conventional moisture-retaining tissue paper products are packed and stored in such a manner, the web will bend under its own weight in a paper box e.g. due to vibration upon shipment or during transportation, leading to difficulty in taking a tissue paper sheet out of the paper box. Owing to the web characteristics and the relationship between the web and a paper box described above, the tissue paper product according to the present invention, despite being moisture-retaining tissue paper having excellent "softness" and "smoothness", has the advantages that the web is less likely to bend in a storage box, and that the moisture-retaining tissue products can be packaged in the same manner as used for general-purpose products. The advantageous effect is pronounced when the moisturizer comprises glycerin and 1,3-propanediol. In the case of the packaging manner shown in FIG. 6, the number of those surfaces of paper boxes which face the top-bottom direction of a cardboard case is relatively large, and therefore the package of the paper boxes as a whole has a relatively high vertical compressive strength. This makes it possible to use a sheet material having a low basis weight for a cardboard case and to thereby reduce the packaging cost. A conventional common base paper for a cardboard case for use in packaging of moisture-retaining tissue products includes an outer layer and a middle layer, each having a basis weight of 170 to 210 g/m$^2$, and a core having a basis weight of 180 to 200 g/m$^2$. A conventional common base paper for a cardboard case for use in packaging of general-purpose tissue products includes an outer layer and a middle layer, each having a basis weight of 160 to 170 g/m$^2$, and a core having a basis weight of 120 to 160 g/m$^2$. Such a cardboard case, commonly used for packaging of general-purpose tissue products and composed of a base paper including an outer layer and a middle layer, each having a basis weight of 160 to 170 g/m$^2$, and a core having a basis weight of 120 to 160 g/m$^2$, can be used for packaging of tissue paper products according to the present invention. Thus, it becomes possible to provide a non-conventional tissue paper product package.

EXAMPLES

Samples of tissue paper products according to the present invention and samples of comparative tissue paper products were prepared, and the samples were subjected to the following tests to evaluate "bending of web (looping, deflection of web)", "tearing on taking-out", "fluffy texture", "softness", "smoothness", and "overall evaluation (buying motive)". Physical property values and compositional values of the samples, and the test results are shown in Table 1 below. The same base tissue paper was used in all the samples. The samples of Comparative Examples 1 to 3 are products of tissue paper containing no moisturizer, while the samples of Examples 1 to 5 and Comparative Examples 4 to 6 are products of moisture-retaining tissue paper containing a moisturizer. The physical property values and the compositional values shown in Table 1 were measured by the following methods.

[Density]

The density of a 2-ply tissue paper sheet was calculated from a calculated 2-ply basis weight (measured 1-ply basis weight×2) and the thickness of the 2-ply tissue paper sheet. Density values (unit: g/cm$^3$) are expressed to two decimal places. The thickness of the 2-ply tissue paper sheet was measured in the above-described manner while keeping the two single sheets of the 2-ply sheet in contact with each other.

[Wet Tensile Strength]

The wet tensile strength was measured according to the tensile test specified in JIS P 8135 (1998).

A test specimen for machine direction and a test specimen for cross-machine direction, each having a width of about 25 mm (±0.5 mm) and a length of about 150 mm, were prepared by cutting a tissue paper sheet. The tissue paper specimens, each consisting of a multi-ply sheet, were used as they were in the measurement. A load cell tensile testing machine TG-200N, manufactured by Minebea Co., Ltd., was used as a testing machine. The chuck-to-chuck distance was set to 100 mm. The measurement was performed by the steps of: fastening both ends of a test specimen, which had been subjected to curing at 105° C. for 10 minutes in a dryer, to the chucks of the testing machine; then applying water horizontally to an about 10 mm-wide middle portion of the test specimen by using a flat brush saturated with water; then immediately applying a vertical tensile load to the test specimen; and reading an indication value (digital value) upon breaking of the test specimen. The tensile speed was set to 50 mm/min. 5 specimens were prepared for each of the machine direction and the cross-machine direction. Thus, the measurement was performed 5 times for each direction, and the average of 5 measurement values for each direction was taken as a wet tensile strength value in the direction.

[Percentage Elongation]

The percentage elongation was measured according to the tensile test specified in JIS P 8113 (1998) using the same test sample and the same measurement procedure as used for measurement of the dry tensile strength, and using the load cell tensile testing machine TG-200N, manufactured by Minebea Co., Ltd.

[Softness]

The softness was measured by the Handle-O-Meter method according to JIS L 1096 method E, using a test specimen (1-ply sheet) having a size of 100 mm×100 mm. The clearance was set to 5 mm. The measurement was performed 5 times for each of the machine direction and the cross-machine direction, and the average of a total of 10 measurement values was taken as a softness value expressed in cN/100 mm. A softness value is an index of the softness of the tissue paper.

[MMD]

MMD (deviation from average coefficient of friction) indicates the degree of deviation from an average coefficient of friction, and is an index of the smoothness of tissue paper. The lower the value, the higher the smoothness. The measurement was performed, using a friction tester KES-SE manufactured by Kato Tech Co., Ltd., by a method which comprises applying a tension of 20 g/cm to a measurement sample in a predetermined direction, and moving a friction block 2 cm at a speed of 0.1 cm/s in approximately the same direction as the direction in which the tension is being applied to the sample while keeping a contact surface of the friction block in contact with the sample at a contact pressure of 25 g. An MMD value is obtained by dividing the coefficient of friction by the friction distance (movement distance=2 cm). The friction block is a square (10 mm×10 mm) piano wire sensor provided as a standard accessary. In particular, the friction block has a contact surface having a size of 10 mm×10 mm and composed of 20 adjacent piano wires P each having a diameter of 0.5 mm. The contact surface has a unit bulging portion whose front end is formed of the 20 piano wires P (the radius of curvature 0.25 mm). The measurement of MMD was performed 5 times for each of the machine direction and the cross-machine direction, and the average of a total of 10 measurement values was taken as an MMD value.

[Contents of Glycerin and 1,3-Propanediol]

The contents of glycerin and 1,3-propanediol each refer to a rate in paper, in particular to the proportion of the mass of glycerin or 1,3-propanediol to the mass of an absolute-dry sample. The "absolute dry" herein refers to a state of a sample in which its weight has become constant after drying it at a temperature of 65° C. and a humidity of 10%.

[Bending of Web]

Moisture-retaining tissue products were packed and stored in a cardboard case, with the short-side surfaces facing in the top-bottom direction of the case as shown in FIG. 6, for one month. Thereafter, the state of a web in a storage box was checked in the following manner. A paper box was placed with the bottom surface downward, and a perforation line for an outlet was torn to form the outlet as commonly performed when taking a first tissue paper sheet out of a paper box, and the web was visually checked for the presence or absence of a bend. Furthermore, the web was taken out of the storage box, and then the web was visually checked if there was a bend in an edge portion which was not visible from the outlet. In Table 1, "X" indicates that the above check revealed the occurrence of a phenomenon (looping) in which the web bends toward the upper surface of the storage box or a phenomenon (web displacement) in which the web is displaced excessively in the storage box and bends in an end portion, while "○" indicates that the above check did not reveal the occurrence of such a phenomenon.

[Tearing on Taking-Out]

"X" indicates a case in which when 2-ply sheets (sets) of tissue paper were taken from the outlet of a storage box one-by-one in a pop-up manner, some sheet(s) was torn, or a case in which the first 2-ply sheet could not be taken out, while "○" indicates that 2-ply sheets of tissue paper could be taken out without such a trouble.

[Sensory Test]

The "fluffy texture", "softness" and "smoothness" were evaluated by 30 evaluators. Each evaluator evaluated each sample in comparison with the sample of Comparative Example 3 as a reference sample, and scored "5" for a sample which was rated as "very excellent", scored "4" for a sample which was rated as "excellent", scored "3" for a sample which was rated as "not excellent but not poor", scored "2" for a sample which was rated as "bad", and scored "1" for a sample which was rated as "very bad". The average of the scores of the evaluators was calculated and taken as an evaluation value.

With reference to the "overall evaluation", each evaluator scored "5" for a sample which was rated as "good texture, very strong purchase intention", scored "4" for a sample which was rated as "good texture, strong purchase intention", scored "3" for a sample which was rated as "average texture, not strong, but not weak purchase intention", scored "2" for a sample which was rated as "poor texture, weak purchase intention", and scored "1" for a sample which was rated as "very poor texture, almost no purchase intention-"The average of the scores of the evaluators was calculated and taken as an evaluation value. .

TABLE 1

| | | | Comp. Ex. 1 | Comp. Ex. 2 | Comp. Ex. 3 | Ex. 1 | Ex. 2 | Ex. 3 |
|---|---|---|---|---|---|---|---|---|
| Production of Paper | Pulp Mixing Ratio | NBKP:LBKP | 30:70 | 30:70 | 30:70 | 30:70 | 30:70 | 30:70 |
| | Percentage Crepe | % | 21.0 | 21.0 | 21.0 | 21.0 | 21.0 | 21.0 |
| | Softener | kg/pulp t | 0.6 | 0.6 | 0.6 | 0.6 | 0.6 | 0.6 |
| | Dry Paper Strength Agent | Kg/pulp t | 0.0 | 0.0 | 0.0 | 0.0 | 0.0 | 0.0 |
| | Wet Paper Strength Agent | kg/pulp t | 1.2 | 1.2 | 1.2 | 1.2 | 1.2 | 1.2 |
| | Cotton Linter | % | 1.0 | 1.0 | 1.0 | 1.0 | 1.0 | 1.0 |
| Application of Chemical | Application of Chemical | applied (yes) or not (no) | no | no | no | yes | yes | yes |
| Components of Moisturizer | Moisturizing Component (Glycerin) | mass % | 0.0 | 0.0 | 0.0 | 79.9 | 78.9 | 79.4 |
| | Moisturizing Component (1,3-Propanediol) | mass % | 0.0 | 0.0 | 0.0 | 5.5 | 6.5 | 6.0 |
| | Softener | mass % | 0.0 | 0.0 | 0.0 | 1.3 | 1.3 | 1.3 |
| | Oily Component | mass % | 0.0 | 0.0 | 0.0 | 2.3 | 2.3 | 2.3 |
| | Emulsifier | mass % | 0.0 | 0.0 | 0.0 | 0.3 | 0.3 | 0.3 |
| | Preservative | mass % | 0.0 | 0.0 | 0.0 | 0.1 | 0.1 | 0.1 |
| | Defoamer | mass % | 0.00 | 0.00 | 0.00 | 0.05 | 0.05 | 0.05 |
| | Water (Water Content in Chemical) | mass % | 0.0 | 0.0 | 0.0 | 10.5 | 10.5 | 10.5 |
| | Total | mass % | 0.0 | 0.0 | 0.0 | 89.5 | 89.5 | 89.5 |
| Chemical Content (Absolute Dry) | Percentage Chemical Content (Containing Water) | mass % | 0.0 | 0.0 | 0.0 | 5.0 | 6.5 | 8.0 |
| | Chemical Content | $g/m^2$ | 0.0 | 0.0 | 0.0 | 1.0 | 1.3 | 1.7 |
| | Percentage Chemical Content (Absolute Dry) | mass % | 0.0 | 0.0 | 0.0 | 4.5 | 5.8 | 7.2 |
| | Glycerin + 1,3-Propanediol (in Chemical) | mass % | 0.0 | 0.0 | 0.0 | 95.4 | 95.4 | 95.4 |
| | Mass Ratio | (glycerin):(1,3-plopanediol) | — | — | — | 1:0.07 | 1:0.08 | 1:0.08 |
| Product Quality | Basis Weight (1P) | $g/m^2$ | 11.9 | 12.3 | 13.7 | 11.7 | 12.0 | 12.5 |
| | Paper Thickness (2P) | μm | 115 | 123 | 180 | 145 | 140 | 143 |
| | Density (2P) | $g/cm^3$ | 0.207 | 0.200 | 0.152 | 0.161 | 0.171 | 0.175 |
| | Dry Tensile Strength (MD) 2P | cN/25 mm | 436 | 312 | 275 | 352 | 312 | 335 |
| | Dry Tensile Strength (CD) 2P | cN/25 mm | 135 | 132 | 89 | 119 | 120 | 114 |
| | Wet Tensile Strength (MD) 2P | cN/25 mm | 232 | 156 | 31 | 170 | 168 | 155 |
| | Wet Tensile Strength (CD) 2P | cN/25 mm | 45 | 39 | 26 | 50 | 55 | 52 |
| | Ratio of Wet Tensile Strength (CD) 2P to Dry Tensile Strength (CD) 2P | cN/25 mm | 0.33 | 0.30 | 0.29 | 0.42 | 0.46 | 0.46 |
| | Percentage Elongation (MD) | % | 10.5 | 10.2 | 16.7 | 13.5 | 11.6 | 12.7 |
| | Softness | cN/100 mm | 1.01 | 0.95 | 0.97 | 1.11 | 1.09 | 1.15 |
| | MMD (front) | 1/100 | 8.2 | 7.1 | 6.7 | 8.3 | 7.6 | 7.4 |
| | Web Compressive Stress | $g/cm^2$ | 0.95 | 0.89 | 0.81 | 0.81 | 0.72 | 0.63 |
| | Tissue Sheet Area/Carton Area | — | 1.51 | 1.51 | 1.71 | 1.50 | 1.51 | 1.51 |
| | Ratio of The Product of Paper Thickness And the Number of Sets to Web Bulk | — | 0.32 | 0.34 | 0.35 | 0.37 | 0.36 | 0.38 |
| | Ratio of Web Bulk to the Height of Paper Box | — | 0.90 | 0.91 | 1.03 | 0.99 | 0.98 | 0.95 |
| | Ratio of the Length of Tissue Paper in CD Direction to the Longitudinal Length of Paper Box | — | 0.84 | 0.84 | 0.94 | 0.85 | 0.85 | 0.85 |
| | Space Volume Ratio | % | 75 | 76 | 94 | 82 | 81 | 79 |
| Looping/ Deflection of Web | ○ Not Observed, X Observed | | ○ | ○ | ○ | ○ | ○ | ○ |
| Tearing on Taking-Out | ○ Not Observed, X Observed | | ○ | ○ | X | ○ | ○ | ○ |
| Sensory Evaluation | Softness | | 2.8 | 2.9 | 3.0 | 3.5 | 3.7 | 3.9 |
| | Smoothness | | 2.8 | 2.8 | 3.0 | 3.4 | 3.5 | 3.7 |
| | Fluffy Texture | | 2.9 | 2.9 | 3.0 | 3.4 | 3.6 | 3.8 |
| | Overall Evaluation (Purchase Intention) | | 2.9 | 2.9 | 3.0 | 3.4 | 3.5 | 3.8 |
| Overall Judgement | | | X | X | X | ○ | ○ | ○ |

| | | | Ex. 4 | Ex. 5 | Comp. Ex. 4 | Comp. Ex. 5 | Comp. Ex. 6 |
|---|---|---|---|---|---|---|---|
| Production of Paper | Pulp Mixing Ratio | NBKP:LBKP | 30:70 | 30:70 | 30:70 | 30:70 | 30:70 |
| | Percentage Crepe | % | 21.0 | 21.0 | 21.0 | 21.0 | 21.0 |
| | Softener | kg/pulp t | 0.6 | 0.6 | 0.6 | 0.6 | 0.6 |
| | Dry Paper Strength Agent | Kg/pulp t | 0.0 | 0.0 | 0.0 | 0.0 | 0.0 |
| | Wet Paper Strength Agent | kg/pulp t | 1.2 | 1.2 | 1.2 | 1.2 | 1.2 |
| | Cotton Linter | % | 1.0 | 1.0 | 1.0 | 1.0 | 1.0 |
| Application of Chemical | Application of Chemical | applied (yes) or not (no) | yes | yes | yes | yes | yes |
| Components of Moisturizer | Moisturizing Component (Glycerin) | mass % | 80.4 | 79.9 | 79.9 | 79.9 | 79.9 |
| | Moisturizing Component (1,3-Propanediol) | mass % | 5.0 | 5.5 | 5.5 | 5.5 | 5.5 |
| | Softener | mass % | 1.3 | 1.3 | 1.3 | 1.3 | 1.3 |
| | Oily Component | mass % | 2.3 | 2.3 | 2.3 | 2.3 | 2.3 |
| | Emulsifier | mass % | 0.3 | 0.3 | 0.3 | 0.3 | 0.3 |

TABLE 1-continued

| | | | | | | | |
|---|---|---|---|---|---|---|---|
| | Preservative | mass % | 0.1 | 0.1 | 0.1 | 0.1 | 0.1 |
| | Defoamer | mass % | 0.05 | 0.05 | 0.05 | 0.05 | 0.05 |
| | Water (Water Content in Chemical) | mass % | 10.5 | 10.5 | 10.5 | 10.5 | 10.5 |
| | Total | mass % | 89.5 | 89.5 | 89.5 | 89.5 | 89.5 |
| Chemical Content (Absolute Dry) | Percentage Chemical Content (Containing Water) | mass % | 9.5 | 11.0 | 11.5 | 12.0 | 12.0 |
| | Chemical Content | $g/m^2$ | 2.0 | 2.3 | 2.5 | 2.6 | 2.6 |
| | Percentage Chemical Content (Absolute Dry) | mass % | 8.5 | 9.8 | 10.3 | 10.7 | 10.7 |
| | Glycerin + 1,3-Propanediol (in Chemical) | mass % | 95.4 | 95.4 | 95.4 | 95.4 | 95.4 |
| | Mass Ratio | (glycerin):(1,3-plopanediol) | 1:0.06 | 1:0.07 | 1:0.07 | 1:0.07 | 1:0.07 |
| Product Quality | Basis Weight (1P) | $g/m^2$ | 12.8 | 13.0 | 13.2 | 13.4 | 13.5 |
| | Paper Thickness (2P) | μm | 135 | 129 | 123 | 120 | 122 |
| | Density (2P) | $g/cm^3$ | 0.190 | 0.202 | 0.215 | 0.223 | 0.221 |
| | Dry Tensile Strength (MD) 2P | cN/25 mm | 299 | 286 | 273 | 268 | 265 |
| | Dry Tensile Strength (CD) 2P | cN/25 mm | 103 | 100 | 95 | 98 | 100 |
| | Wet Tensile Strength (MD) 2P | cN/25 mm | 132 | 116 | 115 | 104 | 99 |
| | Wet Tensile Strength (CD) 2P | cN/25 mm | 50 | 48 | 41 | 42 | 41 |
| | Ratio of Wet Tensile Strength (CD) 2P to Dry Tensile Strength (CD) 2P | cN/25 mm | 0.49 | 0.48 | 0.47 | 0.40 | 0.40 |
| | Percentage Elongation (MD) | % | 11.6 | 11.3 | 11.5 | 11.3 | 11.5 |
| | Softness | cN/100 mm | 1.03 | 1.01 | 1.02 | 0.98 | 0.94 |
| | MMD (front) | 1/100 | 7.3 | 7.1 | 6.8 | 6.5 | 6.2 |
| | Web Compressive Stress | $g/cm^2$ | 0.56 | 0.52 | 0.47 | 0.43 | 0.43 |
| | Tissue Sheet Area/Carton Area | — | 1.51 | 1.51 | 1.50 | 1.53 | 1.53 |
| | Ratio of The Product of Paper Thickness And the Number of Sets to Web Bulk | — | 0.35 | 0.34 | 0.33 | 0.32 | 0.33 |
| | Ratio of Web Bulk to the Height of Paper Box | — | 0.98 | 0.95 | 0.94 | 0.94 | 1.03 |
| | Ratio of the Length of Tissue Paper in CD Direction to the Longitudinal Length of Paper Box | — | 0.84 | 0.84 | 0.84 | 0.85 | 0.85 |
| | Space Volume Ratio | % | 81 | 79 | 77 | 78 | 86 |
| Looping/ Deflection of Web | ○ Not Observed, X Observed | | ○ | ○ | X | X | X |
| Tearing on Taking-Out | ○ Not Observed, X Observed | | ○ | ○ | ○ | ○ | X |
| Sensory Evaluation | Softness | | 4.0 | 4.0 | 4.0 | 4.0 | 4.0 |
| | Smoothness | | 3.9 | 3.8 | 4.0 | 4.0 | 4.1 |
| | Fluffy Texture | | 3.9 | 3.8 | 3.7 | 3.6 | 3.4 |
| | Overall Evaluation (Purchase Intention) | | 3.9 | 3.9 | 3.6 | 3.6 | 3.5 |
| Overall Judgement | | | ○ | ○ | X | X | X |

[Test Results]

While the samples of tissue paper of Comparative Examples 1 to 3, which contain no moisturizer, caused no bending of the web in a storage box, they were poor in the sensory rating for "softness", "smoothness" and "fluffy texture" compared with other examples relating to the moisture-retaining tissue paper. Further, while no bending of the web was observed in the sample of Comparative Example 3, tearing of the tissue paper on taking-out was observed. This may be because the web was stored in an excessively tight state in the storage box.

On the other hand, the samples of Comparative Examples 4 to 6, which are products of moisture-retaining tissue paper, are superior in "softness", "smoothness" and "fluffy texture" to the sample of Comparative Example 3 (reference sample); however, the phenomenon of bending of the web was observed in all the storage boxes of Comparative Examples 4 to 6. In the sample of comparative Example 6, tearing of a tissue paper sheet was observed when taking it out of the storage box in a pop-up manner. Further, in the sample of Comparative Example 6, bending of the web occurred despite the fact that the web was in a more restrained state in the paper box as compared to the webs of Examples 1 to 5. This indicates that bending of a web cannot be improved merely by densely packing the web in a storage box. Further, it is conceivable that when a web is in an excessively restrained state, the cushioning action of the web is less likely to recover a bend of the web. Thus, when the web is once bent, the bend is likely to be maintained, which will make it difficult to smoothly take a tissue sheet out of a storage box. On the other hand, the samples of Examples 1 to 5 according to the present invention are superior in "softness", "smoothness" and "fluffy texture" to the sample of Comparative Example 3 (reference sample), and thus fully have the effects of moisture-retaining tissue paper. Further, the phenomenon of bending of a web was not observed in any of the samples of Examples 1 to 5, and the samples had no trouble in taking out a tissue sheet in a pop-up manner.

The comparative data verifies that the tissue paper product according to the present invention, despite a product of moisture-retaining tissue paper having excellent "softness" and "smoothness", can ensure sufficient cushioning properties of a web. This makes it possible to package the moisture-retaining tissue products in the same manner as used for general-purpose products.

The invention claimed is:

1. A tissue paper product comprising:

a web obtained by folding and stacking in a pop-up manner a plurality of sheets of tissue paper containing a moisturizer; and a rectangular parallelepiped paper box storing the web and having an outlet in its upper surface, wherein the sheets of tissue paper are 2-ply sheets having a 1-ply basis weight of not less than 11.7 g/m2 and not more than 13.0 g/m2 and having a 2-ply paper thickness of more than 123 μm and not more than 145 μm, the dry tensile strength of the tissue paper is more than 273 cN/25 mm and not more than 352 cN/25 mm in the machine direction, and more than 98 cN/25 mm and less than 132 cN/25 mm in the cross-machine direction, and the content of the moisturizer in the tissue paper is not less than 1.0 g/m2 and less than 2.5 g/m2, wherein the web has a web compressive stress of more than 0.47 g/cm2 and less than 0.89 g/cm2, wherein the ratio of the product of the paper thickness and the number of the 2-ply sheets to a web bulk is not less than 0.34, wherein the ratio of the web bulk to the height of the paper box is not less than 0.95 and less than 1.03, wherein the ratio of the length of the tissue paper in the cross-machine direction to the length of the paper box in the longitudinal direction is not less than 0.84, wherein the space volume ratio of the tissue paper product is not less than 79/100; and wherein the space volume ratio is the ratio of the product of the web bulk, a depth of the web and a length of the tissue paper in the cross-machine direction to the product of a height of the external surface of the paper box, a width of the external surface of the paper box and a depth of the external surface of the paper box; and wherein the basis weight, the paper thickness, the dry tensile strength, the content of the moisturizer, the web compressive stress, and the web bulk are measured as detailed herein.

2. The tissue paper product according to claim 1, wherein the moisturizer comprises glycerin and 1,3-propanediol, with the mass ratio between glycerin and 1,3-propanediol being not less than 1:0.06 and not more than 1:0.08, and the content of the moisturizer in the tissue paper is not less than 1.0 g/m2 and less than 2.5 g/m2.

3. A tissue paper product package comprising:

a plurality of tissue paper products, and a cardboard case storing the tissue paper products, the tissue paper products being packed and stored in the cardboard case in such a manner that the short side surfaces of each tissue paper product face in the top-bottom direction of the cardboard case, and the tissue paper products each further comprising a web obtained by folding and stacking in a pop-up manner a plurality of sheets of tissue paper containing a moisturizer; and a rectangular parallelepiped paper box storing the web and having an outlet in its upper surface, wherein the sheets of tissue paper are 2-ply sheets having a 1-ply basis weight of not less than 11.7 g/m2 and not more than 13.0 g/m2 and having a 2-ply paper thickness of more than 123 μm and not more than 145 μm, the dry tensile strength of the tissue paper is more than 273 cN/25 mm and not more than 352 cN/25 mm in the machine direction, and more than 98 cN/25 mm and less than 132 cN/25 mm in the cross-machine direction, and the content of the moisturizer in the tissue paper is not less than 1.0 g/m2 and less than 2.5 g/m2, wherein the web has a web compressive stress of more than 0.47 g/cm2 and less than 0.89 g/cm2, wherein the ratio of the product of the paper thickness and the number of the 2-ply sheets to a web bulk is not less than 0.34, wherein the ratio of the web bulk to the height of the paper box is not less than 0.95 and less than 1.03, wherein the ratio of the length of the tissue paper in the cross-machine direction to the length of the paper box in the longitudinal direction is not less than 0.84, wherein the space volume ratio of the tissue paper product is not less than 79/100; and wherein the space volume ratio is the ratio of the product of the web bulk, a depth of the web and a length of the tissue paper in the cross-machine direction to the product of a height of the external surface of the paper box, a width of the external surface of the paper box and a depth of the external surface of the paper box; and wherein the basis weight, the paper thickness, the dry tensile strength, the content of the moisturizer, the web compressive stress, and the web bulk are measured as detailed herein.

4. The tissue paper product package according to claim 3, wherein the moisturizer comprises glycerin and 1,3-propanediol, with the mass ratio between glycerin and 1,3-propanediol being not less than 1:0.06 and not more than 1:0.08, and the content of the moisturizer in the tissue paper is not less than 1.0 g/m2 and less than 2.5 g/m2.

* * * * *